US007331455B2

(12) United States Patent
Lin

(10) Patent No.: US 7,331,455 B2
(45) Date of Patent: Feb. 19, 2008

(54) TOOL BOX WITH PIVOTING SEATS FOR SCREWDRIVER TIPS

(75) Inventor: Jack Lin, Nantou County (TW)

(73) Assignee: Yih Cheng Factory Co., Ltd., Nantou (TW)

( * ) Notice: Subject to any disclaimer, the term of this patent is extended or adjusted under 35 U.S.C. 154(b) by 251 days.

(21) Appl. No.: 11/177,103

(22) Filed: Jul. 7, 2005

(65) Prior Publication Data

US 2006/0163098 A1 Jul. 27, 2006

(30) Foreign Application Priority Data

Jan. 26, 2005 (TW) ..... 94201476 U

(51) Int. Cl.
*B65D 85/20* (2006.01)
*A47F 7/00* (2006.01)

(52) U.S. Cl. ..... 206/378; 206/372; 211/70.6

(58) Field of Classification Search ..... 206/372–373, 206/376–379; 211/70.6
See application file for complete search history.

(56) References Cited

U.S. PATENT DOCUMENTS

| | | | | |
|---|---|---|---|---|
| 2,590,307 | A * | 3/1952 | Gibson | 206/377 |
| 2,701,052 | A * | 2/1955 | Martel | 206/377 |
| 2,736,426 | A * | 2/1956 | Hamilton | 206/379 |
| 3,564,662 | A * | 2/1971 | Dold | 206/370 |
| 6,050,409 | A * | 4/2000 | Delbeck et al. | 206/375 |
| 6,398,027 | B1 * | 6/2002 | Ryu | 206/372 |
| 6,615,983 | B1 * | 9/2003 | Yu | 206/372 |
| 6,991,103 | B2 * | 1/2006 | Chen | 206/373 |
| 2005/0211587 | A1 * | 9/2005 | Chen | 206/379 |

* cited by examiner

*Primary Examiner*—Bryon P Gehman
(74) *Attorney, Agent, or Firm*—Banger Shia

(57) ABSTRACT

A tool box includes a main body, and a plurality of juxtaposed receiving members each pivotally mounted in the main body for receiving a plurality of screwdriver tips. Thus, each of the screwdriver tips is locked on the respective receiving member efficiently by the clamping effect of the elastic press piece of each of the receiving members, thereby preventing each of the screwdriver tips from being detached from the tool box when not in use.

16 Claims, 7 Drawing Sheets

TOOL BOX WITH PIVOTING SEATS FOR SCREWDRIVER TIPS

BACKGROUND OF THE INVENTION

1. Field of the Invention

The present invention relates to a tool box, and more particularly to a tool box for storing screwdriver tips.

2. Description of the Related Art

A conventional tool box for storing screwdriver tips comprises a main body integrally formed with multiple mounting recesses for mounting the screwdriver tips. However, all of the screwdriver tips are mounted in the mounting recesses, so that a user has to in turn select the required screwdriver tip from the respective mounting recess, thereby causing inconvenience to the user in selection of the screwdriver tips.

SUMMARY OF THE INVENTION

The present invention is to mitigate and/or obviate the disadvantage of the conventional tool box.

The primary objective of the present invention is to provide a tool box having an efficiently clamping effect.

Another objective of the present invention is to provide a tool box, wherein each of the screwdriver tips is locked on the respective receiving member efficiently by the clamping effect of the elastic press piece of each of the receiving members, thereby preventing each of the screwdriver tips from being detached from the tool box when not in use.

A further objective of the present invention is to provide a tool box, wherein the receiving members are pivoted outward from the main body to facilitate the user selecting the screwdriver tips mounted on the receiving members.

A further objective of the present invention is to provide a tool box, wherein each of the receiving members is positioned in the main body temporarily when not in use, thereby preventing each of the receiving members from being pivoted relative to the main body freely.

In accordance with the present invention, there is provided a tool box, comprising a main body, and a plurality of juxtaposed receiving members each pivotally mounted in the main body for receiving a plurality of screwdriver tips.

Further benefits and advantages of the present invention will become apparent after a careful reading of the detailed description with appropriate reference to the accompanying drawings.

DETAILED DESCRIPTION OF THE INVENTION

Figure 1:
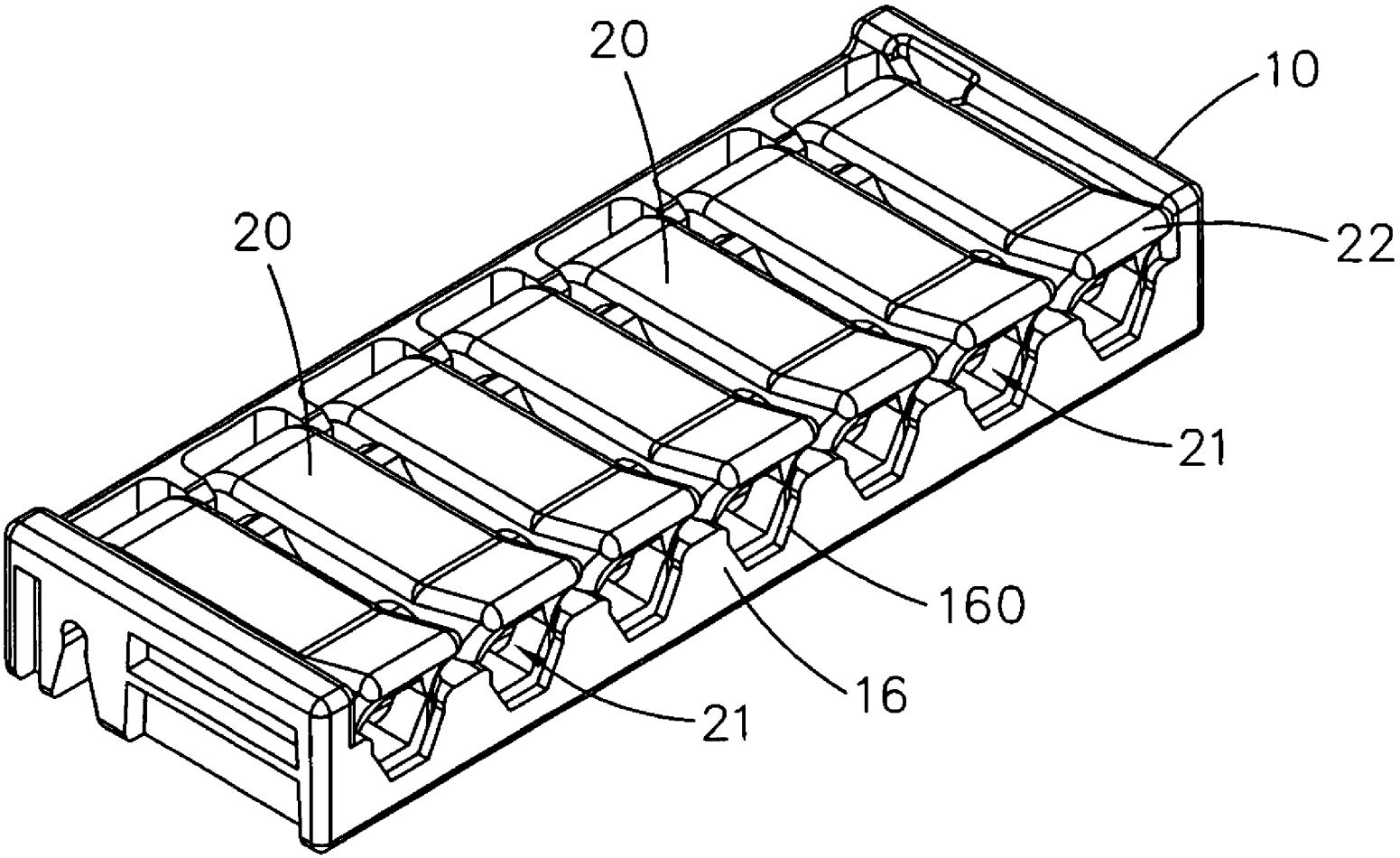
FIG. 1 is a perspective view of a tool box in accordance with the preferred embodiment of the present invention.
Figure 2:
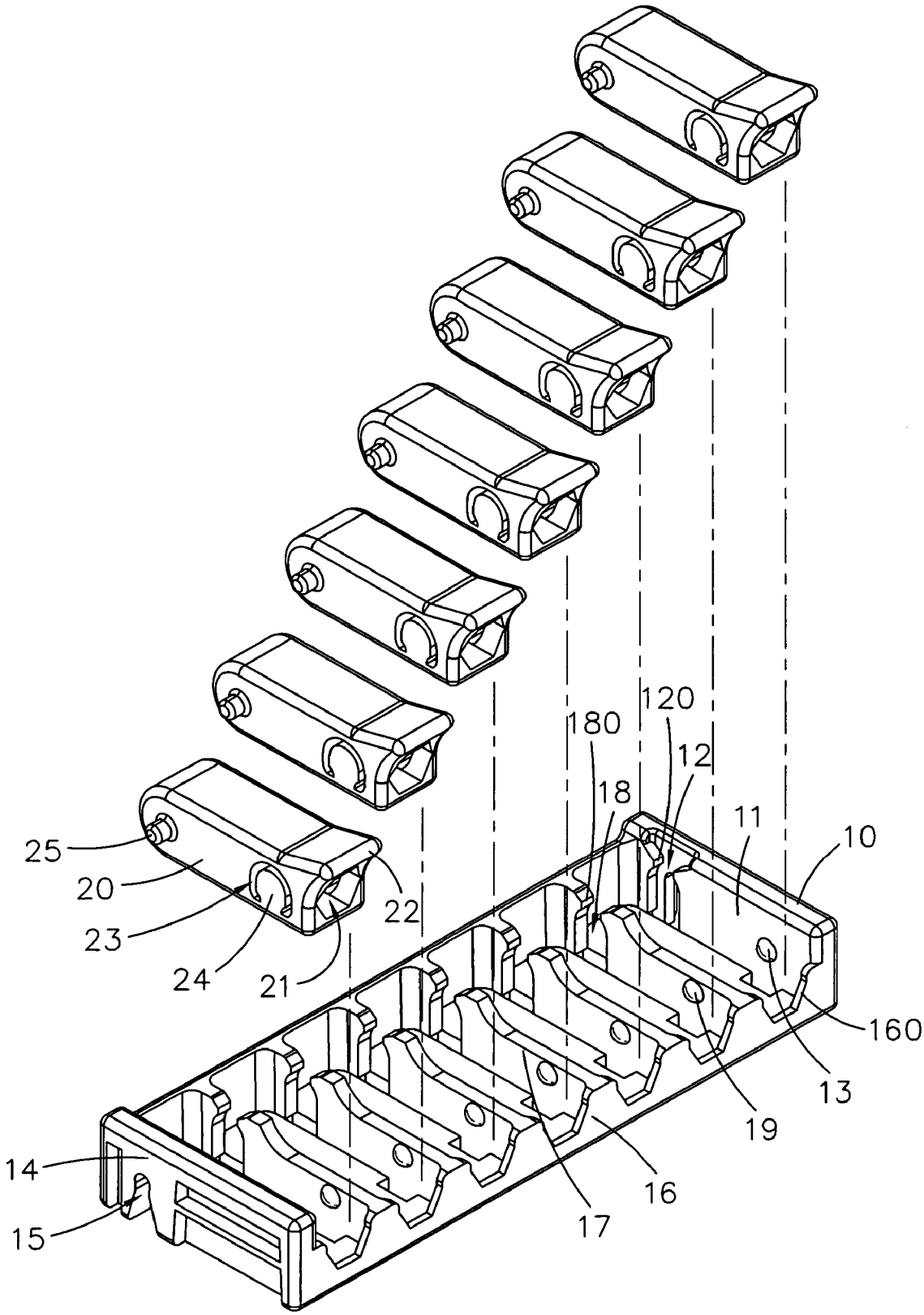
FIG. 2 is an exploded perspective view of the tool box as shown in FIG. 1.

Referring to the drawings and initially to FIGS. 1-5, a tool box in accordance with the preferred embodiment of the present invention comprises a main body 10, and a plurality of juxtaposed receiving members 20 each pivotally mounted in the main body 10 for receiving a plurality of screwdriver tips 30.

The main body 10 has a first end wall 11, a second end wall 14 and an open side wall 16. The first end wall 11 of the main body 10 has a first end formed with a substantially U-shaped clamping slot 12 and a second end formed with a convex boss 13. The clamping slot 12 of the first end wall 11 of the main body 10 has an upper portion formed with two inwardly extended lips 120. The second end wall 14 of the main body 10 has an end formed with a shaft hole 15. The open side wall 16 of the main body 10 is formed with a plurality of openings 160 to allow passage of each of the screwdriver tips 30 as shown in FIG. 5.

The main body 10 has an inside formed with a plurality of separation plates 17 located between the first end wall 11 and the second end wall 14 for separating and supporting the receiving members 20. Each of the separation plates 17 of the main body 10 has a first end formed with a substantially U-shaped clamping slot 18 and a second end formed with a convex boss 19. The clamping slot 18 of each of the separation plates 17 of the main body 10 has an upper portion formed with two inwardly extended lips 180.

The receiving members 20 are pivotally mounted between the first end wall 11, the second end wall 14 and the separation plates 17 of the main body 10. Each of the receiving members 20 has a first end having a first side formed with a pivot seat 26 and a second side formed with a pivot shaft 25. The pivot seat 26 of the receiving members 20 are mounted in the clamping slot 12 of the first end wall 11 and the clamping slots 18 of the separation plates 17 of the main body 10 and limited by the lips 120 of the clamping slot 12 of the first end wall 11 and the lips 180 of the clamping slots 18 of the separation plates 17 of the main body 10. The pivot seat 26 of each of the receiving members 20 is formed with a shaft hole 27. The pivot shaft 25 of each of the receiving members 20 is pivotally mounted in the shaft hole 27 of the pivot seat 26 of an adjacent receiving members 20, and the pivot shaft 25 of one of the receiving members 20 is pivotally mounted in the shaft hole 15 of the second end wall 14 of the main body 10.

Figure 5:
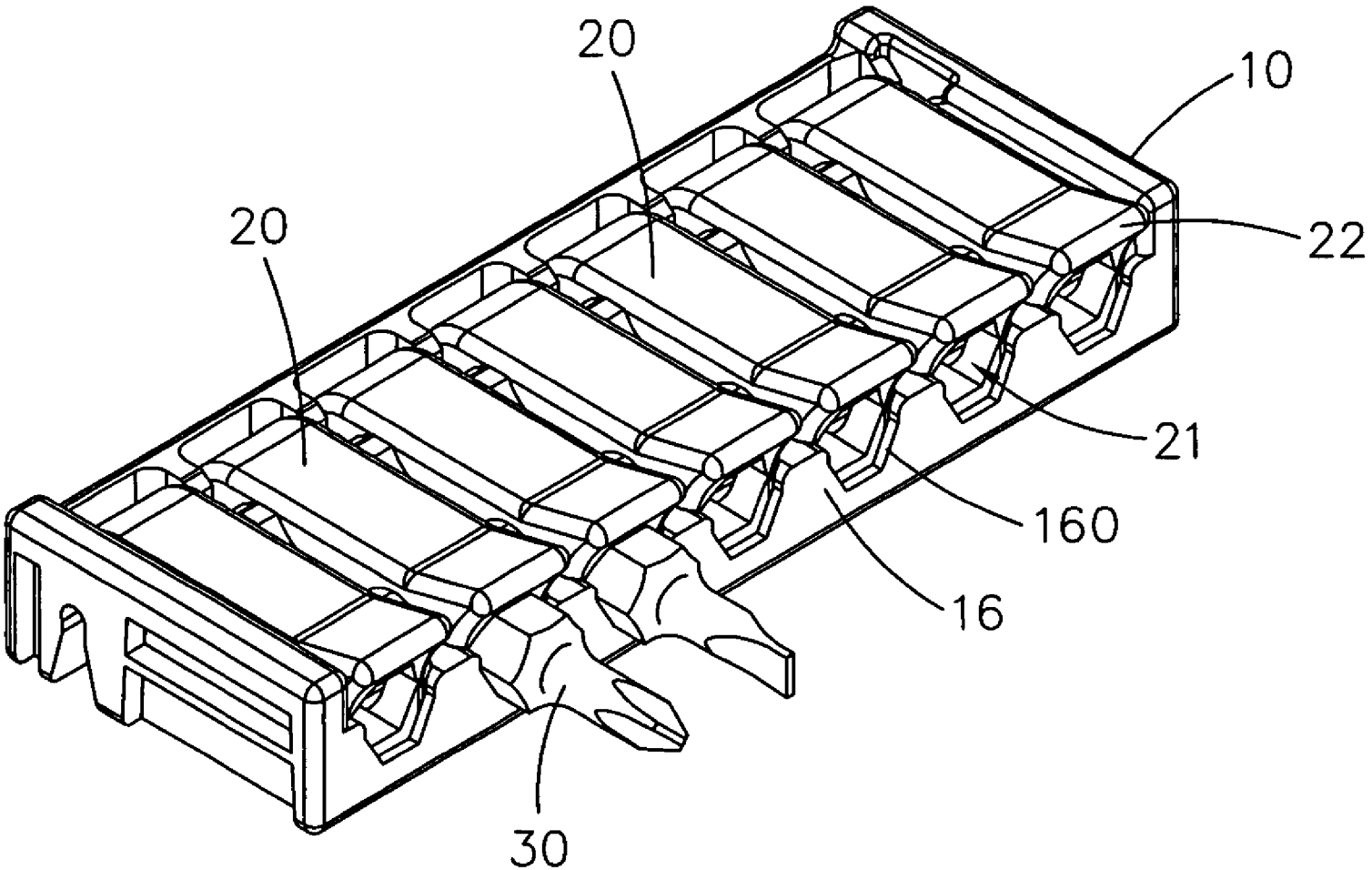
FIG. 5 is a schematic operational view of the tool box as shown in FIG. 1.

Each of the receiving members 20 has a second end having an inside formed with a mounting hole 21 for mounting the respective screwdriver tip 30 as shown in FIG. 5. The second end of each of the receiving members 20 is formed with a protruding push block 22 located above the mounting hole 21 to facilitate a user pushing each of the receiving members 20 upward.

The second end of each of the receiving members 20 has two opposite sides each formed with an arc-shaped slot 23 which defines an arc-shaped elastic press piece 24. The elastic press piece 24 of one of the two opposite sides of the second end of each of the receiving members 20 is formed with a concave recess 240 to receive the convex boss 13 of the first end wall 11 and the convex boss 19 of each of the separation plates 17 of the main body 10 so that each of the receiving members 20 is positioned in the main body 10 temporarily.

The elastic press piece 24 of each of the receiving members 20 is pressed inward by the convex boss 13 of the first end wall 11 and the convex boss 19 of each of the separation plates 17 of the main body 10 to elastically retract into the mounting hole 21 to position the respective screwdriver tip 30 so that each of the screwdriver tips 30 is locked on the respective receiving member 20 rigidly and stably when not in use. After the receiving members 20 are pivoted outward from the main body 10, the elastic press piece 24 of each of the receiving members 20 is released from the convex boss 13 of the first end wall 11 and the convex boss 19 of each of the separation plates 17 of the main body 10 and expanded outward by its elasticity, so that each of the screwdriver tips 30 is unlocked from the respective receiving member 20, thereby facilitating the user removing each of the screwdriver tips 30 from the respective receiving member 20.

Figure 3A:
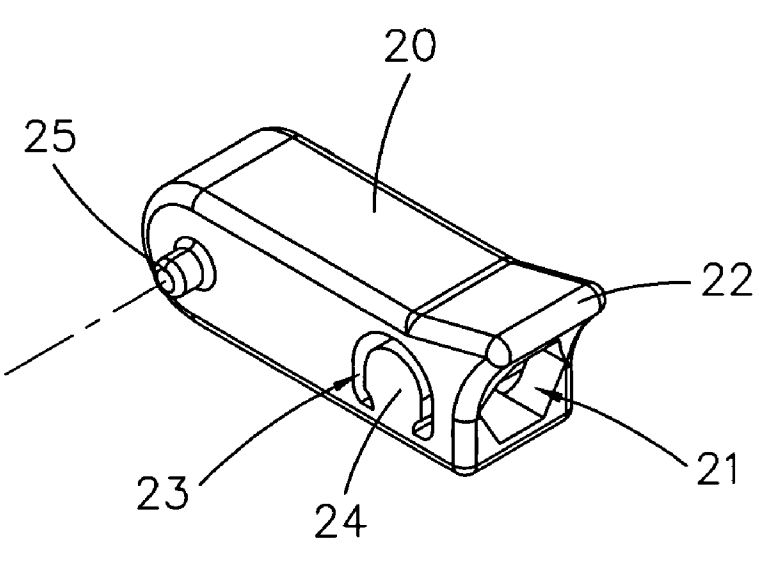
FIG. 3A is a perspective view of the receiving member of the tool box as shown in FIG. 3.
Figure 3:
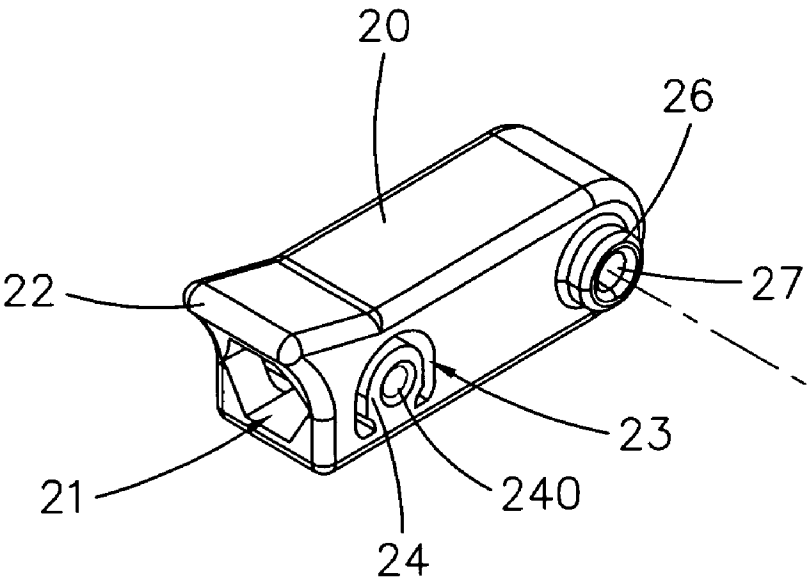
FIG. 3 is a perspective view of a receiving member of the tool box as shown in FIG. 1.

As shown in FIGS. 3 and 3A, the mounting hole 21 of each of the receiving members 20 has a hexagonal shape.

Figure 4:
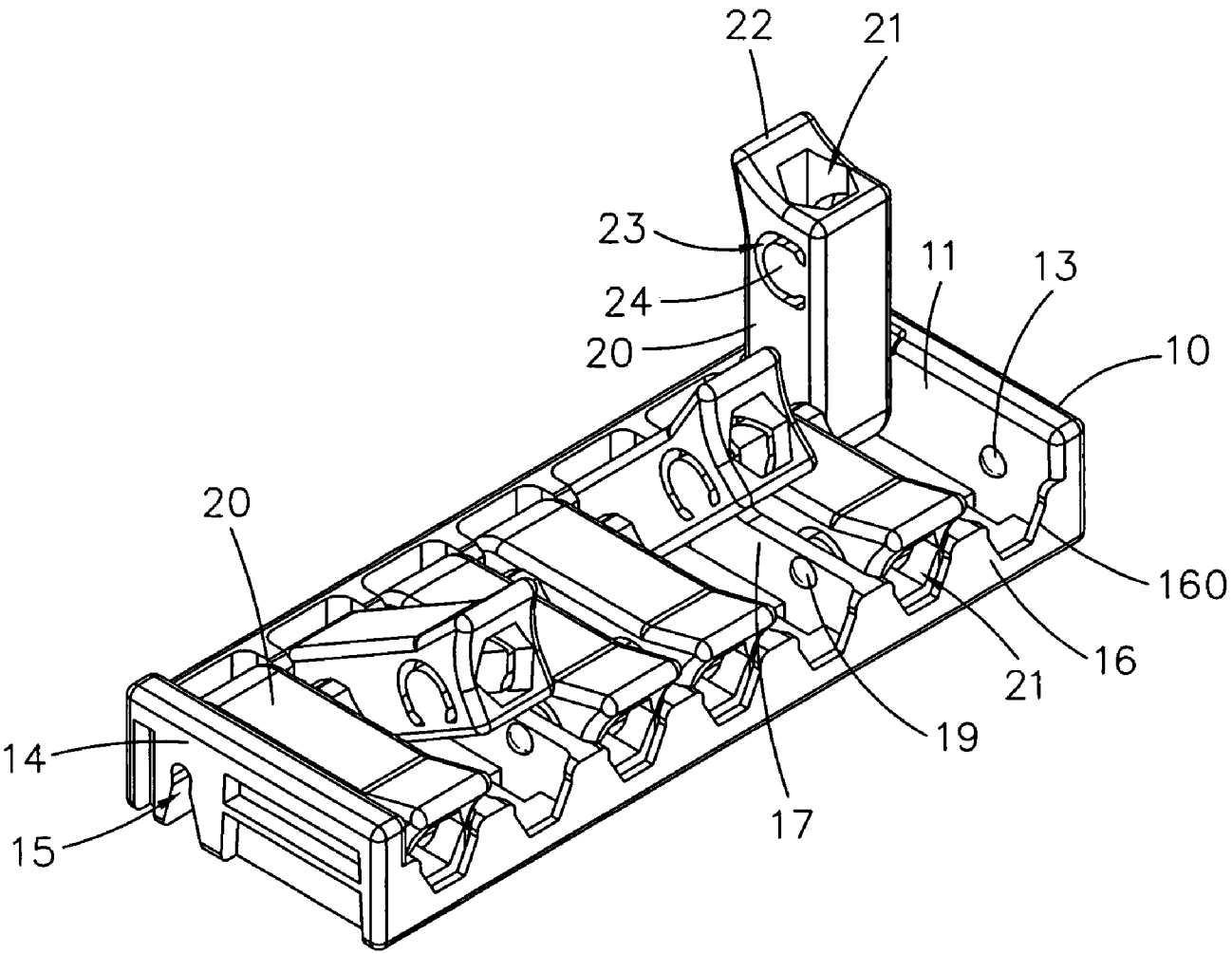
FIG. 4 is a schematic operational view of the tool box as shown in FIG.

As shown in FIG. 4, the receiving members 20 are pivoted outward from the main body 10 to facilitate the user selecting the screwdriver tips 30 mounted on the receiving members 20.

As shown in FIG. 5, the receiving members 20 are retracted into the main body 10 to fold the receiving members 20.

Figure 6:
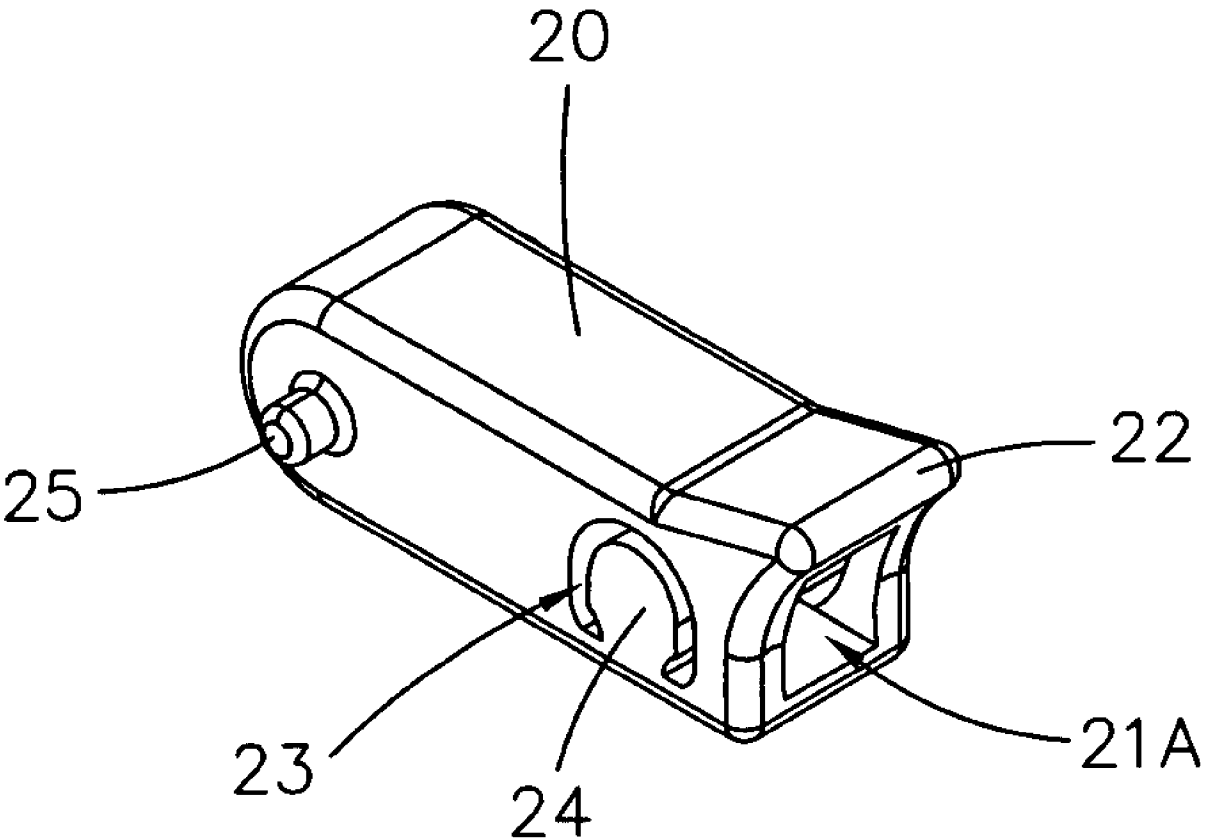
FIG. 6 is a perspective view of a receiving member of a tool box in accordance with another preferred embodiment of the present invention.

As shown in FIG. 6, the mounting hole 21A of each of the receiving members 20 has a square shape.

Figure 7:
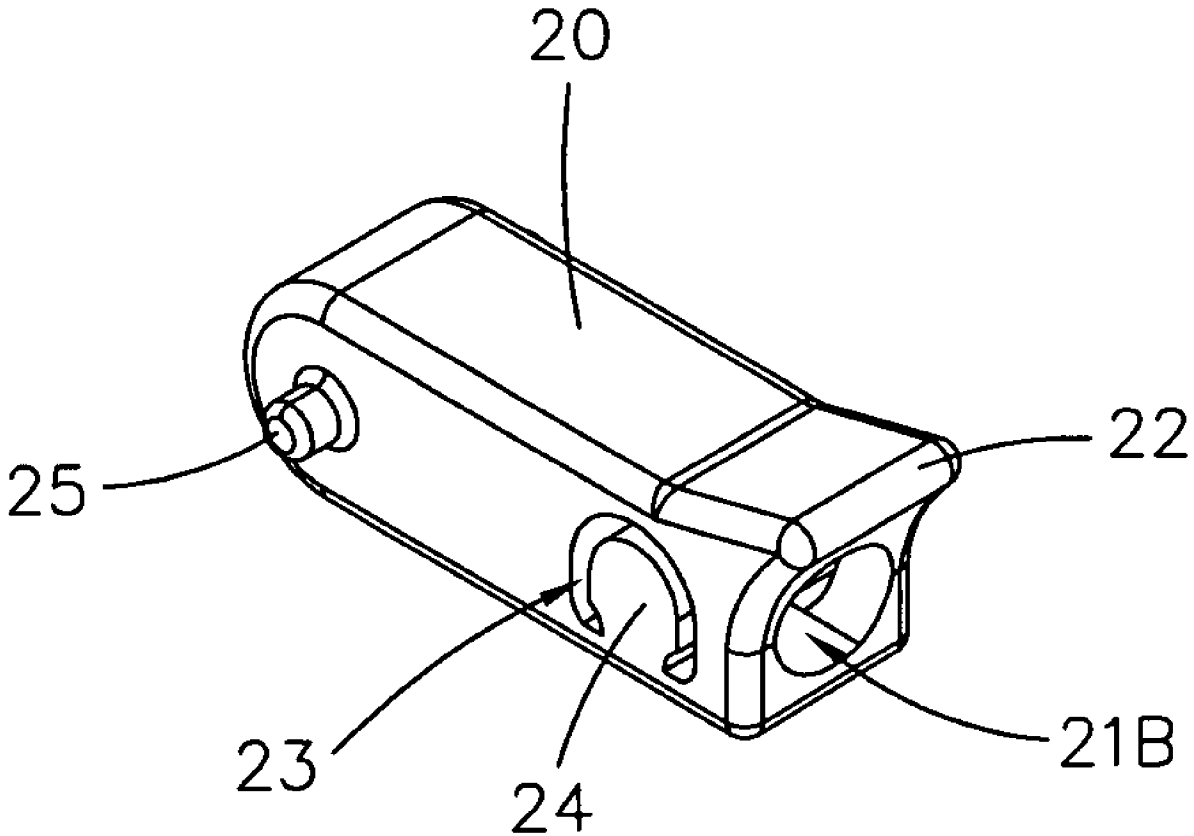
FIG. 7 is a perspective view of a receiving member of a tool box in accordance with another preferred embodiment of the present invention.

As shown in FIG. 7, the mounting hole 21B of each of the receiving members 20 has a circular shape.

Accordingly, each of the screwdriver tips 30 is locked on the respective receiving member 20 efficiently by the clamping effect of the elastic press piece 24 of each of the receiving members 20, thereby preventing each of the screwdriver tips 30 from being detached from the tool box when not in use. In addition, the receiving members 20 are pivoted outward from the main body 10 to facilitate the user selecting the screwdriver tips 30 mounted on the receiving members 20. Further, each of the receiving members 20 is positioned in the main body 10 temporarily when not in use, thereby preventing each of the receiving members 20 from being pivoted relative to the main body 10 freely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool box, comprising:

a main body;

a plurality of juxtaposed receiving members each pivotally mounted in the main body for receiving a plurality of screwdriver tips;

wherein the main body has a first end wall and a second end wall and has an inside formed with a plurality of separation plates located between the first end wall and the second end wall for separating and supporting the receiving members;

the first end wall of the main body has a first end formed with a substantially U-shaped clamping slot, each of the separation plates of the main body has a first end formed with a substantially U-shaped clamping slot, each of the receiving members has a first end having a first side formed with a pivot seat and a second side formed with a pivot shaft, the pivot seats of the receiving members are mounted in the clamping slot of the first end wall and the clamping slots of the separation plates of the main body.

2. The tool box in accordance with claim 1, wherein the clamping slot of the first end wall of the main body has an upper portion formed with two inwardly extended lips, the clamping slot of each of the separation plates of the main body has an upper portion formed with two inwardly extended lips, and the pivot seats of the receiving members are limited by the lips of the clamping slot of the first end wall and the lips of the clamping slots of the separation plates of the main body.

3. The tool box in accordance with claim 1, wherein the pivot seat of each of the receiving members is formed with a shaft hole, and the pivot shaft of each of the receiving members is pivotally mounted in the shaft hole of the pivot seat of an adjacent receiving member.

4. The tool box in accordance with claim 3, wherein the second end wall of the main body has an end formed with a shaft hole, and the pivot shaft of one of the receiving members is pivotally mounted in the shaft hole of the second end wall of the main body.

5. The tool box in accordance with claim 1, wherein each of the receiving members has a second end having an inside formed with a mounting hole for mounting the respective screwdriver tip.

6. The tool box in accordance with claim 5, wherein the second end of each of the receiving members has two opposite sides each formed with an arc-shaped slot which defines an arc-shaped elastic press piece.

7. The tool box in accordance with claim 6, wherein the first end wall of the main body has a second end formed with a convex boss, each of the separation plates of the main body has a second end formed with a convex boss, and the elastic press piece of one of the two opposite sides of the second end of each of the receiving members is formed with a concave recess to receive the convex boss of the first end wall and the convex boss of each of the separation plates of the main body so that each of the receiving members is positioned in the main body temporarily.

8. The tool box in accordance with claim 7, wherein the elastic press piece of each of the receiving members is pressed inward by the convex boss of the first end wall and the convex boss of each of the separation plates of the main body to elastically retract into the mounting hole to position the respective screwdriver tip so that each of the screwdriver tips is locked on the respective receiving member.

9. The tool box in accordance with claim 8, wherein after the receiving members are pivoted outward from the main body, the elastic press piece of each of the receiving members is released from the convex boss of the first end wall and the convex boss of each of the separation plates of the main body and expanded outward by its elasticity, so that each of the screwdriver tips is unlocked from the respective receiving member.

10. The tool box in accordance with claim 6, wherein each of the screwdriver tips is locked on the respective receiving member by the clamping effect of the elastic press piece of each of the receiving members, thereby preventing each of the screwdriver tips from being detached from the tool box.

11. The tool box in accordance with claim 5, wherein the second end of each of the receiving members is formed with a protruding push block located above the mounting hole to facilitate a user pushing each of the receiving members upward.

12. The tool box in accordance with claim 5, wherein the mounting hole of each of the receiving members has a hexagonal shape.

13. The tool box in accordance with claim 5, wherein the mounting hole of each of the receiving members has a square shape.

14. The tool box in accordance with claim 5, wherein the mounting hole of each of the receiving members has a circular shape.

15. The tool box in accordance with claim 1, wherein the main body has a side wall formed with a plurality of openings to allow passage of each of the screwdriver tips.

16. The tool box in accordance with claim 1, wherein the receiving members are pivotally mounted between the first end wall, the second end wall and the separation plates of the main body.

* * * * *